US008453883B2

(12) United States Patent
Habermann et al.

(10) Patent No.: US 8,453,883 B2
(45) Date of Patent: Jun. 4, 2013

(54) PERSONAL DEFENSE SPRAY DEVICE

(75) Inventors: Sven Habermann, Maple Ridge (CA); Brian Perrin, Belcara (CA); Freddie Tsang, Vancouver (CA); Ying-Chiu Chan, Vancouver (CA)

(73) Assignee: Bigfoot Holdings Ltd., Maple Ridge (CA)

( * ) Notice: Subject to any disclaimer, the term of this patent is extended or adjusted under 35 U.S.C. 154(b) by 757 days.

(21) Appl. No.: 12/406,905

(22) Filed: Mar. 18, 2009

(65) Prior Publication Data

US 2010/0237103 A1 Sep. 23, 2010

(51) Int. Cl.
*B65D 83/00* (2006.01)

(52) U.S. Cl.
USPC . 222/153.13; 222/183; 222/325; 222/402.11; 224/914; 169/75

(58) Field of Classification Search
USPC ..... 222/183, 402.11, 153.11–153.14, 222/399, 608–628, 325, 182; 340/573.1, 340/425.5, 574, 693.5; 239/146; 215/12, 215/12.1; 169/74–75, 62, 88; 224/195, 197, 224/914
See application file for complete search history.

(56) References Cited

U.S. PATENT DOCUMENTS 4,815,541 A * 3/1989 Arrington ..... 169/74
5,374,919 A * 12/1994 Zelka et al. ..... 340/574
5,476,192 A * 12/1995 Julinot ..... 222/78
5,531,359 A * 7/1996 Winner ..... 222/153.11
6,026,990 A * 2/2000 Brunswig ..... 222/153.13
6,145,654 A * 11/2000 Loghman ..... 206/37

* cited by examiner

*Primary Examiner* — Kevin P Shaver
*Assistant Examiner* — Andrew P Bainbridge

(57) ABSTRACT

A self defense spray device comprising a spray unit having a spray canister with an irritant spray, a nozzle operable to release the irritant spray, and a first connector attached to the spray canister. The device further includes a holder having a second connector adapted to releasably engage the first connector to releasably connect the spray unit to the holder, and a safety mechanism that prevents the nozzle from releasing the spray when the spray unit is connected to the holder, thus disarming the device. Once the spray unit is removed from the holder, the safety no longer blocks the nozzle thus arming the device.

19 Claims, 5 Drawing Sheets

PERSONAL DEFENSE SPRAY DEVICE

BACKGROUND

1. Field of the Invention

The present invention relates to systems and devices used for personal defense, specifically to compact, non-lethal irritant or chemical spray devices.

2. Description of the Prior Art

Prior art defensive spray devices, particularly personal self defense sprays using chemical irritant sprays (including pepper or mace sprays) to ward off attacks from animals or other assailants, typically comprise a spray canister containing a pressurized irritant spray such as a chemical repellent. The spray canister is typically carried on the person in a purse or handbag, backpack or other carry bag. To use the spray, the user must first find it among all other items in the bag in which the spray is carried, remove the device from the bag and insure that the nozzle is pointing towards the threat. Then the user must remove some form of safety, which typically consist of a cap or trigger locking wedge or pin. A problem with such deployment is that too much time elapses from the time the user becomes aware of the threat to the time that the device is ready to be effectively used. This is further exacerbated by stress arising from the user being startled. There is often very little time in which to react and deploy the self defense spray device. The user will have very little time to reach for, locate, extricate, orient the spray canister and release the safety mechanism. Even in situations where a user has kept the device in a conventional holder at the user's side on a belt, the user must still remove the device from the holder and orient the device to insure that the nozzle is pointing towards the threat. This is because the typical self defense spray canister is freely rotatable within the conventional holders. Then the user must release the safety. With many of the prior art devices, these steps are often time consuming and necessitate the use of both hands. During an encounter with an aggressive assailant (person or animal), the events can unfold so rapidly that fractions of a second lost in both time and attention on account of locating and deploying the device can mean the difference between successfully repelling the attack and being injured by it.

SUMMARY OF THE INVENTION

The present invention provides a personal self defense spray device that may be comfortably carried on lanyard or string hung around one's neck, clipped to an article of clothing such as a belt at the user's side, or otherwise mounted within reach of the user, and which enables an irritant spray to be rapidly deployed with minimal effort and attention on the part of the user, and using only one hand thereby freeing the other hand for balance or striking.

In some embodiments, the personal self defense device of the present invention comprises a spray subassembly comprising a spray canister containing a pressurized irritant spray and having a valve therein capable of being actuated to release the irritant spray, a nozzle in fluid communication with the valve and operable to actuate the valve to release the irritant spray via the nozzle, and a first connector attached to the spray canister; a holder comprising a second connector adapted to releasably engage with the first connector to releasably connect the spray subassembly to the holder, a safety mechanism that cooperates with the spray subassembly to interfere with the actuation of the valve by the nozzle when the spray subassembly is connected to the holder thereby disarming the spray subassembly and to not interfere with the actuation of the valve by the nozzle when the spray subassembly is not connected to the holder thereby arming the spray subassembly. Some embodiments may be provided with an attachment means for releasably attaching the holder to another item.

In some embodiments the device may including a spray housing adapted to receive at least a portion of the spray canister and wherein the first connector is a part of the spray housing. In some embodiments the holder comprises a holder housing adapted to receive the first connector.

In some embodiments the first connector may comprises a horizontal member extending from the spray housing and includes a keeper portion, and the second connector comprises a latch member that is moveable by the user to selectively engage and disengage the keeper portion to effect the latching and unlatching of the spray subassembly to the holder.

In some embodiments the latch member is moveable in a sideways direction and is adapted to engage and disengage the keeper portion as a result of the latch member being so moved. In some embodiments the latch member is biased towards a position in which the latch member engages the keeper portion. In some embodiments the latch member includes a cam following element and the keeper portion includes a cam element that cooperates with the cam following element to displace the latch member against the bias as the horizontal member is brought into initial contact with the latch member, and which releases the cam following element once the keeper portion moves beyond the cam following element such that the latch member returns to the position in which it engages the keeper portion.

Some embodiments the holder may include a connector cover moveable between a first position in which it allows access by a user to the latch member, and a second position in which it prevents access by the user to the latch member, thereby minimizing accidental disengagement of the spray subassembly from the holder.

In some embodiments the safety mechanism comprises at least one projection that interferes with the movement of the nozzle only when the spray subassembly is connected to the holder to prevent the nozzle from actuating the valve.

Some embodiments of the present invention may include a light source mounted in the spray subassembly, a first source of electrical power connected to the light source, a first electrical circuit connecting the first source of power to the light source, a first electrical switch connected to the first electrical circuit and configured to complete the first electrical circuit when the spray subassembly is disconnected from the holder thereby providing illumination, and to break the first electrical circuit when the spray subassembly is connected to the holder thereby terminating illumination. In some embodiments, the light source may be a strobe light.

In some embodiments, the spray subassembly may be provided with a high intensity LED or other light that is oriented to shine a bright beam of light in the direction of the spray. Preferably, the light has a switch that is activated to turn on the light as soon as the spray subassembly is removed from the holder. The bright light provides a targeting means for the spray nozzle and also provides illumination under very low light conditions. And at night, the high intensity light shining in the assailant's or animal's eyes may be enough to ward off an attack.

Some embodiments of the present invention may include an electrical sound generator mounted on the holder, a second source of electrical power connected to the sound generator, a second electrical circuit connecting the second source of power to the sound generator, a second electrical switch connected to the second electrical circuit and configured to complete the second electrical circuit when the spray subassembly is disconnected from the holder thereby providing an audible alarm, and to break the second electrical circuit when the spray subassembly is connected to the holder thereby terminating the audible alarm.

In some embodiments, the holder may be provided with a high decibel audible alarm with a switch mechanism that is activated as soon as the spray subassembly is removed from the holder. The addition of an audible alarm advantageously provides a warning to the attacker and it may on its own be sufficient to ward off an attack, thereby obviating the need to use the spray canister. The audible alarm also provides warning to other people in the vicinity that an encounter is taking place so that they can act accordingly in either calling for or rendering additional assistance to the person being attacked. Once the danger is over and the spray canister may be replaced into the holder, the alarm's switch deactivates the alarm. The alarm in preferred embodiments can only be deactivated when the canister is put back on the holder.

To deploy the device, the user reaches over to the device with one hand and in one motion slides the safety mechanism cover downward to expose the latch mechanism, depresses the release lever on the latch mechanism to release the spray subassembly, and then withdraws the spray subassembly from the holder. Once the spray canister is removed from the holder, the trigger button is free and ready to be depressed to release the repellent spray. Advantageously, since the spray canister was retained on the holder portion facing in a forward orientation relative to the user's hand, the nozzle of the spray device is already pointing forward in the user's hand and the user's attention need not be diverted toward orienting the spray nozzle. In one relatively smooth motion, the spray canister is ready to be used in self defense. Once the danger has passed, the spray canister is replaced into the holder subassembly and the latch mechanism is reengaged to secure the spray subassembly to the holder, while at the same time the safety mechanism is reengaged to prevent the inadvertent release of spray.

DETAILED DESCRIPTION

It will be understood that the present disclosure is an exemplification of the principles of the invention and does not limit the invention to the illustrated embodiments. Therefore, specific details disclosed herein are not to be interpreted as limiting, but rather as a basis for the claims and as a representative basis for teaching one skilled in the art to employ the present invention. Directional references such a up, down, fore, aft, left, right, rearward and the like refer to the device in the orientation in which it would be normally held by a user, specifically with canister portion held in the user's hand such that the outlet of the spray points away from the user in a forward direction.

Figure 1:
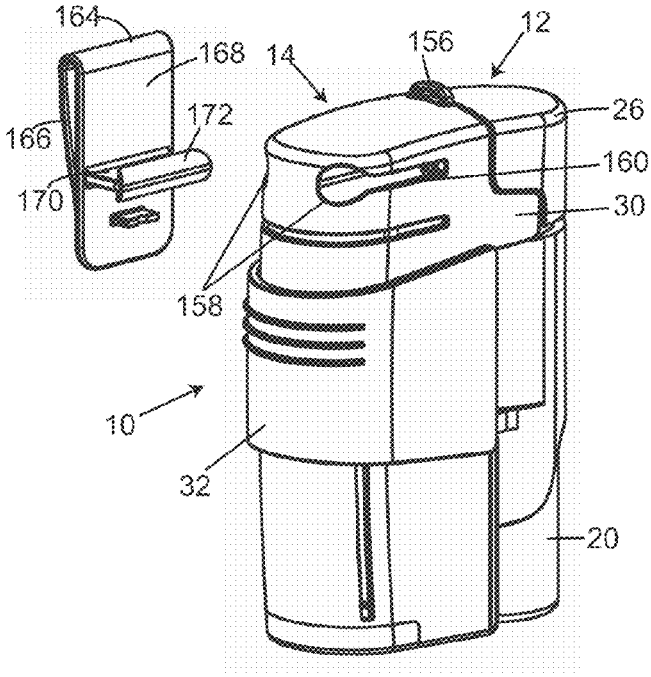
FIG. 1 is a perspective view of an embodiment of a personal defense device comprising a holder subassembly (shown on the left) to which is releasably connected a spray subassembly (shown on the right), hence the devices in the storage configuration.
Figure 2:
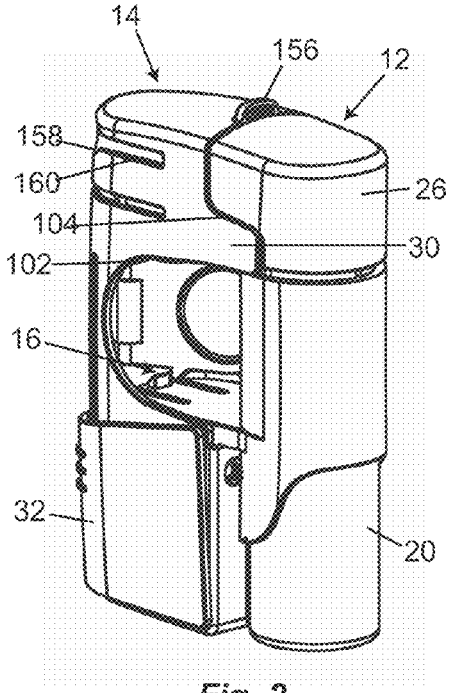
FIG. 2 is a perspective view of the embodiment in FIG. 1 in which the latch mechanism cover has been slid down to reveal the latching mechanism.
Figure 3:
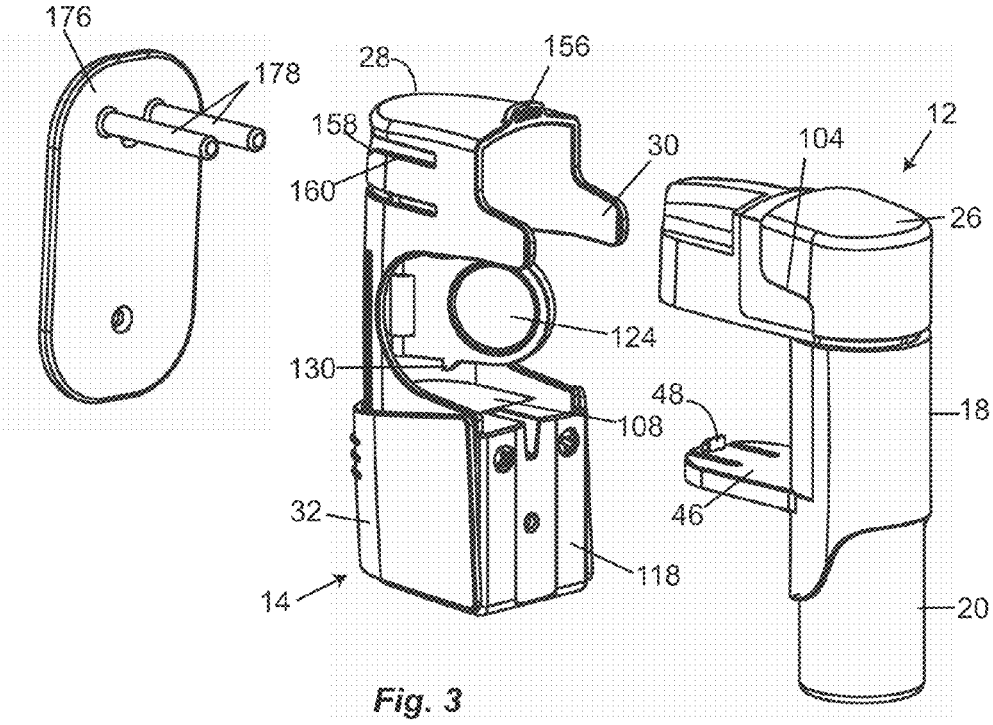
FIG. 3 is a perspective view of the of the embodiment in FIG. 1 in the armed configuration in which the holder subassembly and the spray subassembly are disconnected from each other.

Referring to FIGS. 1-3, an embodiment of a personal defense spray device of the present invention is shown generally by reference number 10. Personal defense spray device 10 comprises a spray subassembly 12 that is removably connected to a holder such as holder subassembly 14 by a latch mechanism shown generally by number 16. The term "subassembly" as used herein is in accordance with its ordinary dictionary meaning of a unit assembled separately but designed to fit with other units in a manufactured device.

The spray subassembly 12 comprises an aerosol spray canister 20 of the kind known in the prior art and typically contains a pressurized irritant spray comprising a propellant and an irritant such as mace, pepper or other suitable chemical irritant. The spray subassembly 12 includes a spray housing 18 that comprises a rear housing portion 22 adapted to receive the spray canister 20, and a forward housing portion 24 (shown in FIGS. 5 & 6). A nozzle 26 is also provided and is in fluid communication with the valve in the spray canister 20. The nozzle 26 is depressible to actuate the valve to release the irritant spray via the nozzle 26.

The holder subassembly 14 comprises a holder housing 28 that includes a safety mechanism which may comprise at least one projection such as rearward extending lateral tabs 30. The holder housing 28 includes the latch mechanism 16 that cooperates with the spray subassembly 12 to selectively latch or unlatch the spray subassembly 12 from the holder subassembly 14. The holder housing 28 also includes a latch mechanism cover 32 that is slidably connected to the holder housing 28. The latch mechanism cover 32 functions as a connector cover that is moveable between a first position and a second position and is operable to respectively expose or cover the latch mechanism 16.

In FIG. 1, the spray subassembly 12 is shown connected to the holder subassembly 14 and therefore the personal defense spray device 10 is in a storage configuration in which the safety mechanism or rearward extending lateral tabs 30 interfere with the nozzle 26 to prevent it from being depressed, thereby preventing the spray from being released. Whereas in FIG. 2, the spray subassembly 12 and the holder subassembly 14 are shown disconnected and apart from each other and therefore the personal defense spray device 10 is in an armed configuration in which the nozzle 26 may be depressed to release the spray from the spray canister. Accordingly, it will be understood that the safety mechanism (the rearward extending tabs 30 in the illustrated embodiment) cooperates with the spray subassembly to interfere with the actuation of the valve in the spray canister 20 by the nozzle (identified as item 26 in the illustrated embodiment).

Figure 4:
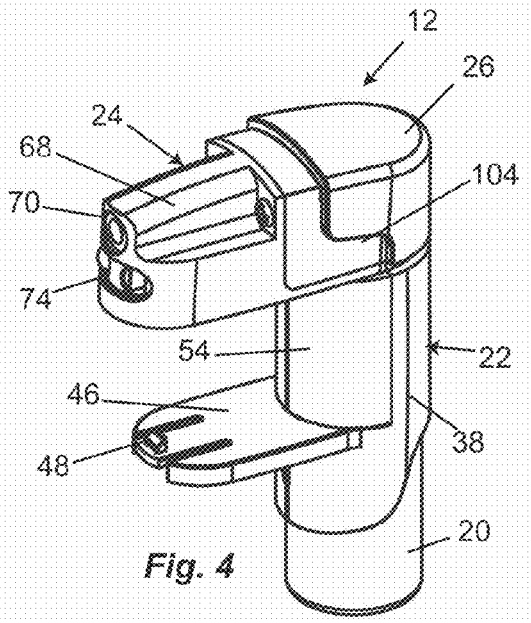
FIG. 4 is a perspective view from the front left of the spray subassembly shown in FIG. 1.
Figure 5:
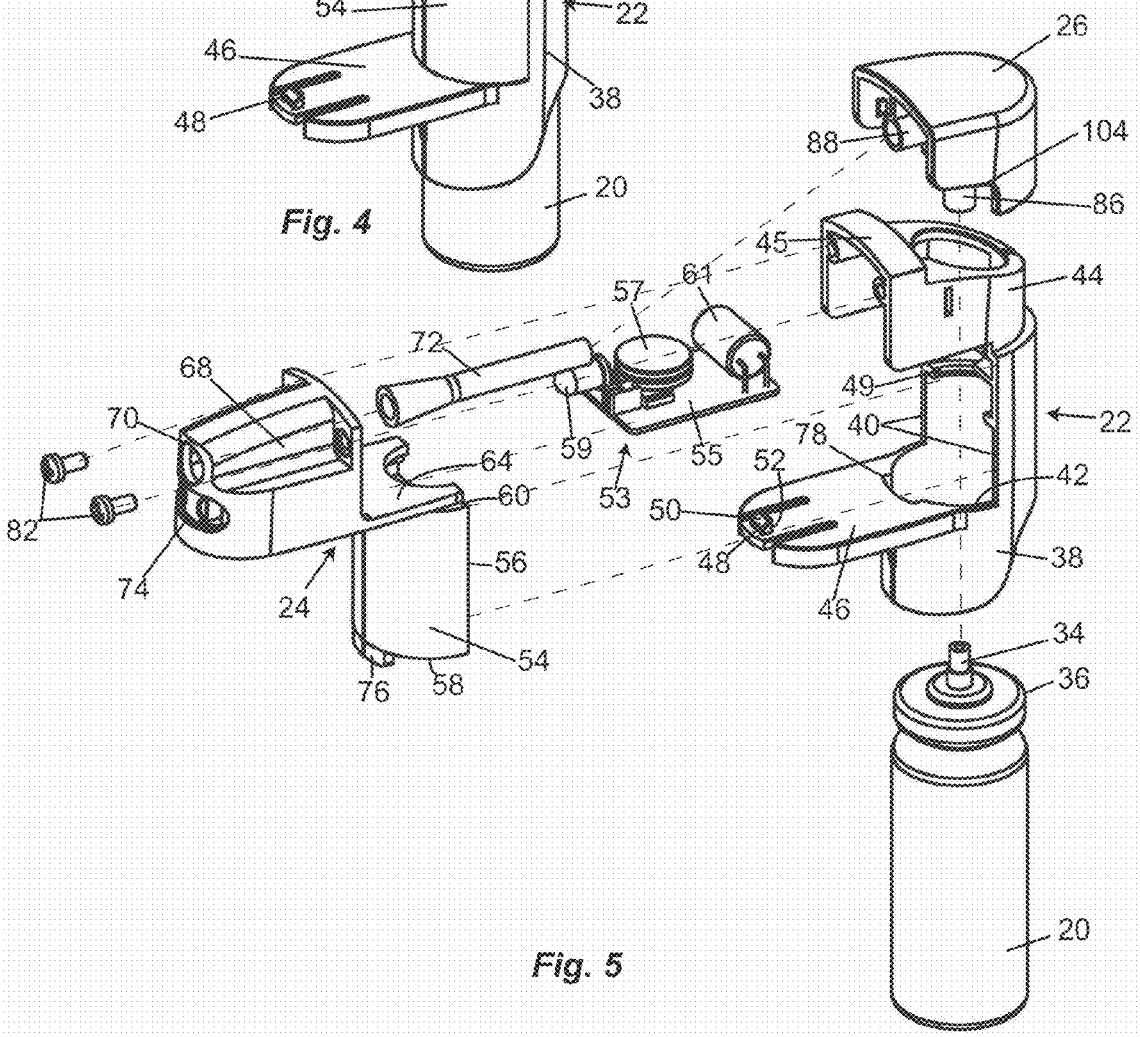
FIG. 5 is an exploded view from the front left of the spray subassembly shown in FIG. 1.
Figure 6:
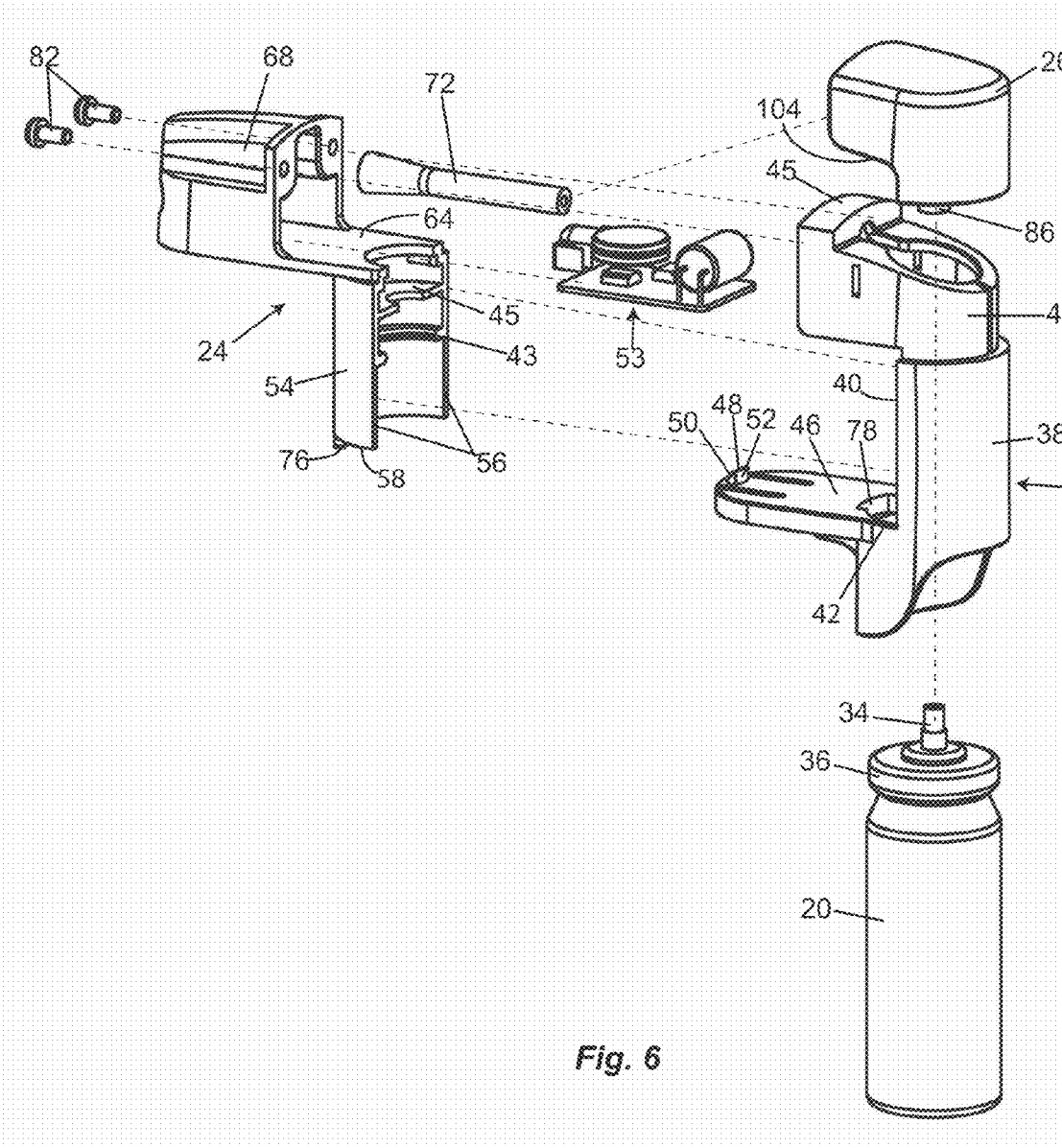
FIG. 6 is an exploded view from the rear left of the spray subassembly shown in FIG. 1.

FIGS. 4 and 5 show an exploded view of the spray subassembly 12. As is known in the art, spray canister 20 is a pressurized vessel having an internal release valve (not shown) which is operably connected to a delivery tube 34 and cooperates therewith such that the act of depressing the delivery tube 34 into the canister causes the valve to release the pressurized contents from within the canister via the delivery tube. Typically, the internal release valve is biased towards the closed position such that the act of releasing the delivery tube allows a valve to close, thereby stopping the flow of the pressurized contents from the spray canister 20. At the top of the spray canister 20, surrounding the delivery tube 34, is a canister head 36 by which the spray canister may be attached to the spray head subassembly 18. These kinds of spray canisters are common in the field of art of chemical irritant sprays.

The rear housing portion 22 of the spray housing 18 comprises a cylindrical member 38 that defines a central bore adapted to closely receive the body of the spray canister 20. The cylindrical member 38 is provided with a forward facing opening that defines vertical edges 40 and horizontal bottom edge 42. The upper end of the cylindrical member 38 defines a seat portion 44 that is adapted to receive nozzle 26, and a bracket portion 45 fore of the seat portion 44. A first connector such as a horizontal member or platform 46 extends forward from a point adjacent to the horizontal bottom edge 42 of the cylindrical member 38, and includes a keeper portion such as a transverse ridge 48 on the upper surface of the platform 46 at its terminal end. The ridge 48 includes a cam element such as sloped and concavely curved front wall 50 and a vertical back wall 52.

A high intensity light source 53 is included comprising of a circuit board 55, batteries 57, an LED light 59, a capacitor 61, and an associated electrical contact or switch (not shown). In some embodiments, a high intensity strobe light may be preferred.

The forward housing portion 24 of the spray subassembly 12 comprises a vertically oriented semi-cylindrical member 54 that defines vertical side edges 56 and horizontal bottom edge 58 and top edge 60. The semi-cylindrical member 54 is complementary to the cutaway opening in the cylindrical member 38 that defines the edges 40 and 42 such that the vertical side edges 56 abut the vertical edges 40 when the two members are brought together. From the top edge 60 of the semi cylindrical member 54 extends a forward facing horizontal platform 64 on which is provided a housing 68 for the nozzle extension tube 72 and the light source 53. The housing 68 includes a front wall in which is provided a spray discharge port 70 for receiving the forward end of the nozzle extension tube 72 and a light port 74 for receiving the LED light 59.

The bottom edge 58 of the semi cylindrical member 54 includes a tab 76 that is adapted to be received in a complementary slot 78 in the horizontal platform 46 adjacent the edge 40. Accordingly, the forward housing portion 24 may be removably connected to the rear housing portion 22 by means of screws 82 that connect the forward housing portion 24 to the bracket portion 45 such that the semi cylindrical member 54 abuts that part of the cylindrical member 38 having the cutaway opening to close that opening (as shown in FIG. 4). The inside surface of the cylindrical member 38 near the seat portion 44 includes a circumferential flange 49 that cooperates with a similar circumferential flange 43 on the inside surface of the semi-cylindrical member 54 to engage the canister head 36 for retaining the spray canister 20 within the spray head subassembly 18. Above these are collar flanges (shown as 45 on the semi cylindrical member 54 but not shown on the cylindrical member 38) which cooperate to define a collar for locating the delivery tube 34 within the rear housing portion 22.

The nozzle 26 includes a lower conduit 86 that is in fluid communication with a forward facing upper conduit 88. The lower conduit 86 is adapted to receive the delivery tube 34 of the spray canister 20 and the upper conduit 88 is adapted to receive nozzle extension tube 72. Once released from the spray canister, the irritant spray flows from the delivery tube 34, through the lower conduit 86, upper conduit 88, and out through the nozzle extension tube 72.

Figure 7:
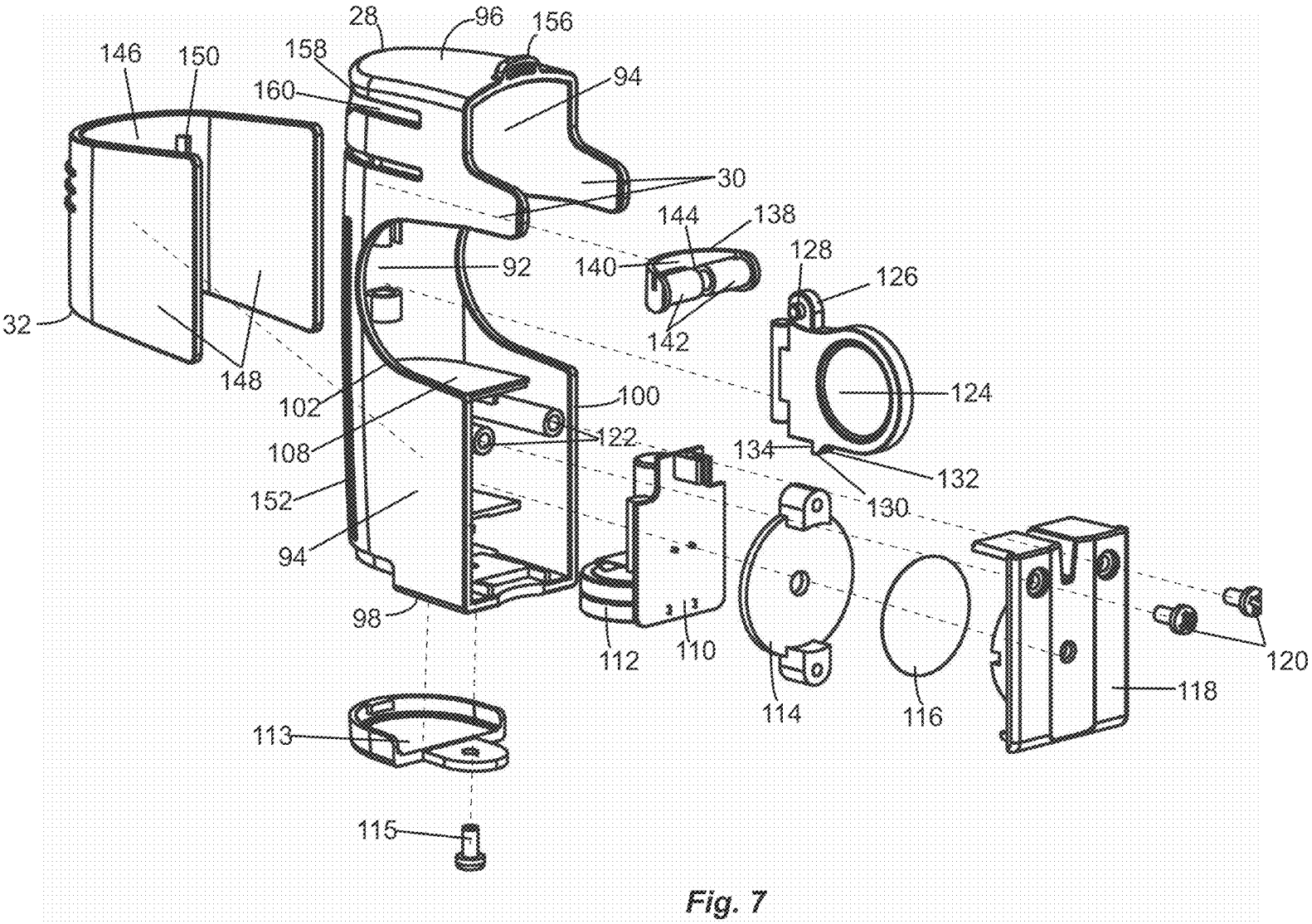
FIG. 7 is an exploded view from the rear left of the holder subassembly shown in FIG. 1.
Figure 8:
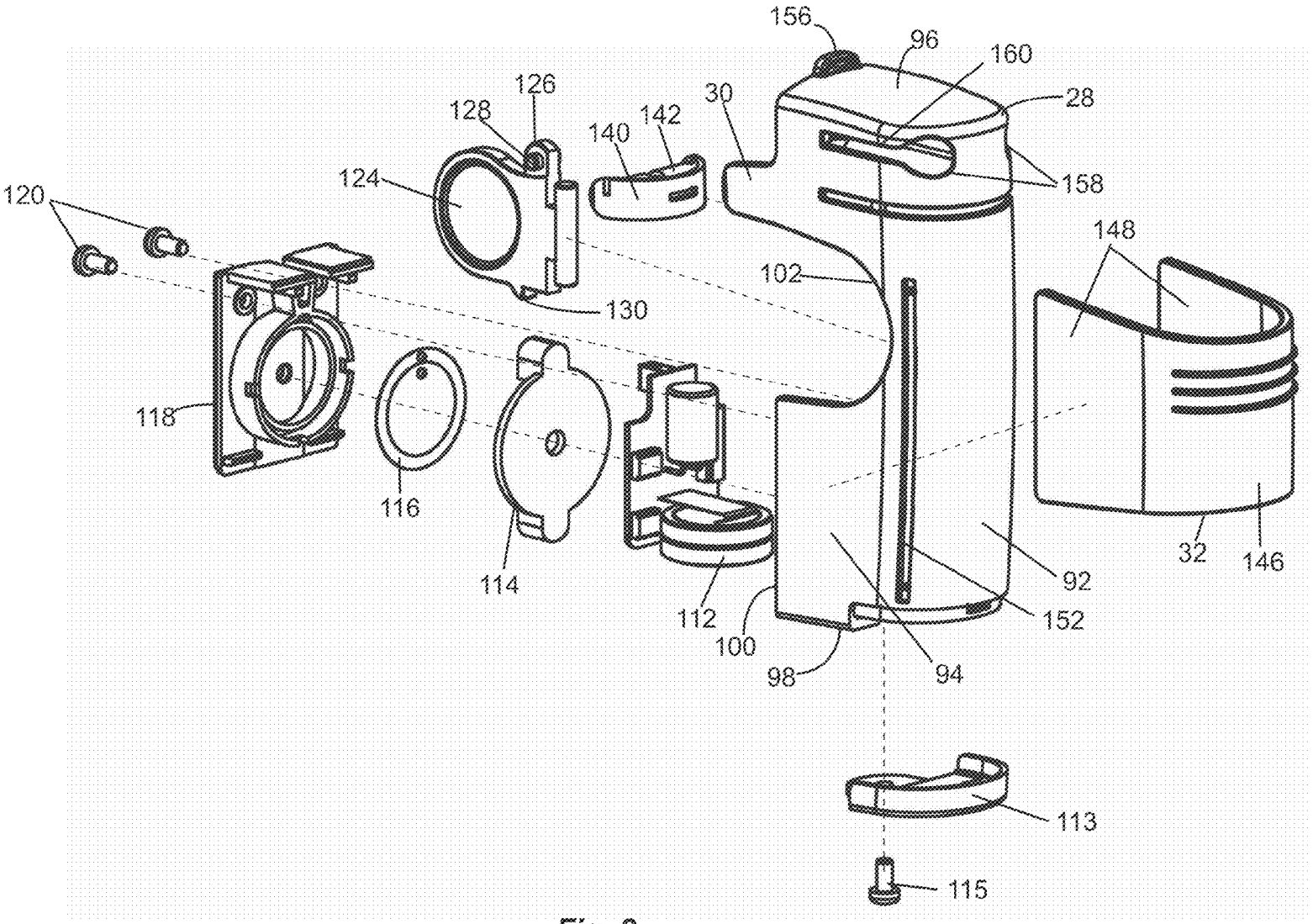
FIG. 8 is an exploded view from their front right of the holder subassembly shown in FIG. 1.

Referring to FIGS. 7 and 8, the holder subassembly 14 comprises holder housing 28 having a front wall 92, sidewalls 94, a top wall 96 and a bottom wall 98, which together define a back edge 100 of the housing. The sidewalls 94 each include a forwardly extending cutaway portion 102, and the rearward extending lateral tabs 30 that are each complimentary to recess 104 in the side walls of the nozzle 26. On the inside of the housing near the bottom edge defined by the cutaway portion 102 is provided a horizontal platform 108 that extends between the sidewalls 94 and the front wall 92. This platform and the bottom wall 98 define a cavity within which an audible alarm subassembly is mounted. The audible alarm subassembly comprises of a circuit board 110, batteries 112, sound chamber cover 114, piezo element 116 which are held in place by a retaining bracket 118 that is connected to the housing by means of screws 120 driven in two corresponding threaded protrusions 122 on the holder housing 28.

A second connector or latch member such as release lever 124, which is part of the latch mechanism 16, is mounted for hinged horizontal movement on the inside surface of the front wall 92 at a location adjacent to the opening defined by the cutaway portion 102. The release lever 124 includes an upwardly protruding tab 126 having small horizontal projections 128 on each side, and a downwardly protruding hook portion 130 having a cam following element such as a sloped backward facing edge 132, and a vertical forward facing edge 134. The release lever 124 is biased towards a central position in line with a medial plane of the holder housing 28, in which the lever is generally parallel to the sidewalls 94, by a biasing member 138 comprising of a semicircular plate 140 made of a semi rigid material and having inwardly facing cylindrical portions 142 at each end that define a central gap 144. The biasing member 138 is mounted to the inside surface of the front wall 92 at a position such that the tab 126 of the release lever 124 fits closely within the central gap 144 whereby the horizontal projections 128 fit within the cylindrical portions 142. The resistance of the semicircular plate to straightening acts on the cylindrical portions 142 tending to bring them together and narrowing the central gap 144, and this force is transmitted to the tab 126 to bias the release lever 124 towards the central position. Of course, other ways of biasing the release lever 124 are possible.

The latch mechanism cover 32 comprises a front wall 146 and two sidewalls 148 wherein the latch mechanism cover 32 is adapted to fit closely over the front wall 92 and sidewalls 94 of the holder housing 28. On the inside surface of the latch mechanism cover 32 are provided parallel vertical ridges 150 that are dimensioned to be slidably received within corresponding and complementary vertical grooves 152 on the outside surface of the holder housing 28. Thereby, the latch mechanism cover 32 is slidable vertically on the housing such that the sidewalls 148 selectively cover and uncover the opening defined by the cutaway 102 on the housing to expose or cover the latch mechanism 16 therein.

The bottom wall 98 of the housing and 90 includes a battery access opening (not shown) to enable the user to replace the batteries 112 for the audible alarm. A removable battery access cover 113 closes this opening and is held in place by a screw 115.

The outer surface of top wall 96 is provided with a lanyard loop 156 for ease of carrying of the device. In addition, the front wall 92 of the holder housing 28, adjacent to top wall 96 and the sidewalls 94, includes a pair of holes 158 that are each invaded by a horizontal slot 160 extending along the side walls 94. A belt clip 164 is provided comprising of a clip portion 166 connected to a vertical plate member 168 from which extends a horizontal transverse tab 170 that terminates in a cylindrical end portion 172. The cylindrical end portion 172 is dimensioned to be able to slide into one of the holes 158 such that the transverse tab 170 slides into a corresponding horizontal slot 160, thereby enabling the holder housing 28 to be removably mounted onto the belt clip 164 for ease of carrying of the device. Alternatively or in addition, a mounting bracket 176 is provided which includes a pair of parallel rods extending from the mounting bracket 176 whereby the rods are dimensioned to simultaneously slide into the holes 158 to enable the holder housing 28 to be removably mounted upon the bracket 176. The bracket itself may be mounted to a wall, the interior of the vehicle, or any other suitable object on which it may be desirable to removably mount the personal defense spray device 10. Accordingly, the lanyard loop 156, the belt clip 164 and the mounting bracket 176 each function as an attachment means for releasably attaching the holder subassembly 14 to another item.

Referring to FIG. 3, the spray subassembly 12 and the holder subassembly 14 are shown apart but aligned. This orientation represents either the position just after they have been separated or just prior to them being reconnected. Advantageously, the forward housing portion 24 of the spray subassembly 12 is dimension to fit within the top portion of the holder housing 28 on the holder subassembly 14, above the cutaway 102, and when the nozzle portion is received within the housing, the rearward extending lateral tabs 30 are positioned so as to cooperate with the corresponding recesses 104 on the nozzle 26 to act as a safety mechanism for preventing the button from being inadvertently depressed and accidentally release the irritant spray. Furthermore, the horizontal platform 46 on the spray subassembly is adapted to being inserted into the holder housing 28 at a position just above the horizontal platform 108 on the housing. The release lever 124 is dimensioned and positioned such that the hook portion 130 is able to engage the transverse ridge 48 on the horizontal platform 46 when said platform is inserted into the holder housing 28.

Referring to FIG. 1, the personal defense spray device 10 is shown in the storage configuration in which the spray subassembly 12 is located and held within the holder subassembly 14 by the latch mechanism 16. The latch mechanism cover 32 is shown in a position in which its sidewalls 148 enclose the latch mechanism from access. To remove the spray subassembly 12 from the holder subassembly 14, the latch mechanism cover 32 is first slid downward to expose the latch mechanism 16, as shown in FIG. 2. While the personal defense spray device 10 is in the storage configuration the release lever 124 is biased towards the medial plane of the housing such that the front wall 134 of the hook portion 130 on the release lever 124 engages the vertical back wall 52 of the transverse ridge 48 on the horizontal platform 46, thereby latching the spray subassembly 12 to the holder subassembly 14. To effect the unlatch of the spray subassembly from the holder subassembly, a user inserts a digit in to the holder housing 28 via and opening defined by the cutaway 102 in the side wall 94 to access the release lever 124 and move the release lever laterally (i.e. sideways) so that the hook portion 130 disengages from the transverse ridge 48. With the device unlatched, the user is able to remove the spray subassembly 12 from the holder subassembly 14. Once the two assemblies are separated from each other, the device is in an armed configuration in which the irritant spray may be discharged from the spray subassembly by depressing nozzle 26. Advantageously, the configuration of the personal defense spray device 10 is such that a user can affect the unlatching and removal of the spray subassembly 12 from the holder subassembly 14 with one hand and in one fluid motion simply by moving a hand towards the spray subassembly as if to grasp it and inserting a middle finger into the holder housing 28 via an opening defined by the cutaway 102 to effect the unlatching of the spray subassembly, and then continuing the motion to grasp and remove the spray subassembly 12 from the holder subassembly 14. Once this motion is complete the spray subassembly will be properly positioned within the user's hand to enable the user to quickly discharge the spray towards the point to danger—i.e. the nozzle of the device will be pointing away from the user and the user's thumb will be positioned above the nozzle 26.

In order to return the personal defense spray device 10 to the storage configuration, the user aligns the spray subassembly 12 with the holder subassembly 14 as shown in FIG. 3 and inserts the spray subassembly into the holder subassembly 14. As the horizontal platform 46 is inserted into the holder housing 28, the sloped and curved front wall 50 of the transverse ridge 48 engages the sloped backward facing edge 132 of the hook portion 130 of the release lever 124 causing the release lever to be displaced laterally, thereby enabling the transverse ridge 48 to clear the hook portion 130. Once the spray subassembly is fully inserted into the holder subassembly, and the transverse ridge is clear of the hook portion, the biasing member 138 returns to release lever to its resting position aligned with the medial plane of the housing and 90, thereby latching the spray subassembly to the holder subassembly. The user then slides the latch mechanism cover 32 upward to enclose the latch mechanism 16 to prevent the accidental unlatching of the spray subassembly.

Two sets of electrical switches or contacts are provided (not shown): one in the spray subassembly 12 for activating the light circuit and one in the holder subassembly 14 for activating the audible alarm circuit. Each electrical switch is positioned and configured to open its respective electrical circuit when the personal defense spray device 10 is in the storage configuration and to close their respective electrical circuit as soon as the spray subassembly is removed from the holder subassembly thereby causing the device to simultaneously emit both a loud and shrill audible alarm to warn other persons nearby of an attack, and a bright light to stun the assailant and/or illuminate the target at which the spray is aimed. While the described and illustrated embodiment of the personal defense device is shown with both an audible alarm and a light, other embodiments of the present invention may include one or the other of these features, or omit both altogether.

While the above description and illustrations constitute preferred or alternate embodiments of the present invention, it will be appreciated that numerous variations may be made without departing from the scope of the invention. Thus, the embodiments described and illustrated herein should not be considered to limit the invention as construed in accordance with the accompanying claims.

The invention claimed is:

1. A self defense spray device comprising:

a spray subassembly and a holder wherein the spray subassembly and the holder are separate units that are adapted to be releasably connected to each other;

the spray subassembly comprising a spray canister containing a pressurized irritant spray and having a valve therein capable of being actuated to release the irritant spray, a nozzle in fluid communication with the valve and operable to actuate the valve to release the irritant spray via the nozzle, and a first connector attached to the spray canister, the first connector having a keeper portion, wherein the spray subassembly is functional as a distinct unit for discharging the irritant spray;

the holder comprising a second connector having a latch member adapted to releasably engage with the keeper portion of the first connector to releasably connect the spray subassembly to the holder, and a safety mechanism that is adapted to cooperate with the spray subassembly to interfere with the actuation of the valve by the nozzle;

wherein when the spray subassembly is connected to the holder, the safety mechanism interferes with the actuation of the valve by the nozzle to prevent a discharge of the irritant spray at any time while the spray subassembly remains connected to the holder; and wherein when the spray subassembly is separated from the holder, the safety mechanism does not interfere with the actuation of the valve by the nozzle to enable a discharge of irritant spray from the spray subassembly.

2. The device of claim 1 further including a spray housing adapted to receive at least a portion of the spray canister and wherein the first connector is a part of the spray housing.

3. The device of claim 2 wherein the holder comprises a holder housing adapted to receive the first connector.

4. The device of claim 3 wherein the first connector comprises a horizontal member extending from the spray housing and includes the keeper portion, and wherein the latch member is moveable by the user to selectively engage and disengage the keeper portion to effect the latching and unlatching of the spray subassembly to the holder.

5. The device of claim 4 wherein the latch member is moveable in a sideways direction and is adapted to engage and disengage the keeper portion as a result of the latch member being so moved.

6. The device of claim 5 wherein the latch member is biased towards a position in which the latch member engages the keeper portion.

7. The device of claim 6 wherein the latch member includes a cam following element and the keeper portion includes a cam element that cooperates with the cam following element to displace the latch member against the bias as the horizontal member is brought into initial contact with the latch member, and which releases the cam following element once the keeper portion moves beyond the cam following element such that the latch member returns to the position in which it engages the keeper portion.

8. The device of claim 7 wherein the holder further includes a connector cover moveable between a first position in which it allows access by a user to the latch member, and a second position in which it prevents access by the user to the latch member, thereby minimizing accidental disengagement of the spray subassembly from the holder.

9. The device of claim 8 wherein the safety mechanism comprises at least one projection that interferes with the movement of the nozzle only when the spray subassembly is connected to the holder to prevent the nozzle from actuating the valve.

10. The device of claim 1 wherein the safety mechanism comprises at least one projection that interferes with the movement of the nozzle only when the spray subassembly is connected to the holder to prevent the nozzle from actuating the valve.

11. The device of claim 10 wherein the holder comprises a holder housing adapted to receive the first connector, the at least one projection extends from the holder housing, and the nozzle includes at least one recess adapted to receive the at least one projection when the spray subassembly is connected to the holder.

12. The device of claim 11 further including a spray housing adapted to receive at least a portion of the spray canister and wherein the first connector is a part of the spray housing.

13. The device of claim 12 wherein the first connector comprises a horizontal member extending from the spray housing and includes a keeper portion, and the second connector comprises a latch member that is moveable by the user to selectively engage and disengage the keeper portion to effect the latching and unlatching of the spray subassembly to the holder.

14. The device of claim 13 wherein the latch member is moveable in a sideways direction and is adapted to engage and disengage the keeper portion as a result of the latch member being so moved.

15. The device of claim 14 wherein the latch member is biased towards a position in which the latch member engages the keeper portion.

16. The device of claim 15 wherein the latch member includes a cam following element and the keeper portion includes a cam element that cooperates with the cam following element to displace the latch member against the bias as the horizontal member is brought into initial contact with the latch member, and which releases the cam following element once the keeper portion moves beyond the cam following element such that the latch member returns to the position in which it engages the keeper portion.

17. The device of claim 16 wherein the holder further includes a connector cover moveable between a first position in which it allows access by a user to the latch member, and a second position in which it prevents access by the user to the latch member, thereby minimizing accidental disengagement of the spray subassembly from the holder.

18. The apparatus of claim 1 further including a light source mounted in the spray subassembly, a first source of electrical power connected to the light source, a first electrical circuit connecting the first source of power to the light source, a first electrical switch connected to the first electrical circuit and configured to complete the first electrical circuit when the spray subassembly is disconnected from the holder thereby providing illumination, and to break the first electrical circuit when the spray subassembly is connected to the holder thereby terminating illumination.

19. The apparatus of claim 1 further including an electrical sound generator mounted on the holder, a second source of electrical power connected to the sound generator, a second electrical circuit connecting the second source of power to the sound generator, a second electrical switch connected to the second electrical circuit and configured to complete the second electrical circuit when the spray subassembly is disconnected from the holder thereby providing an audible alarm, and to break the second electrical circuit when the spray subassembly is connected to the holder thereby terminating the audible alarm.

* * * * *